US010584918B2

(12) United States Patent
Repasky et al.

(10) Patent No.: US 10,584,918 B2
(45) Date of Patent: Mar. 10, 2020

(54) CONTINUOUS MIXED REFRIGERANT OPTIMIZATION SYSTEM FOR THE PRODUCTION OF LIQUEFIED NATURAL GAS (LNG)

(71) Applicant: GE Oil & Gas, LLC, Schertz, TX (US)

(72) Inventors: John Michael Repasky, New Braunfels, TX (US); Matthew Thibodeaux, San Antonio, TX (US); Anindra Mazumdar, Katy, TX (US)

(73) Assignee: GE Oil & Gas, LLC, Schertz, TX (US)

( * ) Notice: Subject to any disclaimer, the term of this patent is extended or adjusted under 35 U.S.C. 154(b) by 164 days.

(21) Appl. No.: 15/714,812

(22) Filed: Sep. 25, 2017

(65) Prior Publication Data

US 2018/0209724 A1 Jul. 26, 2018

Related U.S. Application Data

(60) Provisional application No. 62/472,694, filed on Mar. 17, 2017, provisional application No. 62/449,794, filed on Jan. 24, 2017.

(51) Int. Cl.
*F25J 1/02* (2006.01)
*F25J 1/00* (2006.01)
(Continued)

(52) U.S. Cl.
CPC ..... *F25J 1/0249* (2013.01); *F25B 9/006* (2013.01); *F25B 45/00* (2013.01); *F25J 1/0022* (2013.01); *F25J 1/0055* (2013.01); *F25J 1/0092* (2013.01); *F25J 1/025* (2013.01); *F25J 1/0212* (2013.01); *F25J 1/0252* (2013.01); *F25J 1/0269* (2013.01); *F25J 1/0214* (2013.01); *F25J 1/0217* (2013.01); *F25J 2210/04* (2013.01);
(Continued)

(58) Field of Classification Search
CPC ..... F25J 1/0249; F25J 1/0022; F25J 1/0211; F25J 1/0212; F25B 49/00
See application file for complete search history.

(56) References Cited

U.S. PATENT DOCUMENTS 4,809,154 A * 2/1989 Newton ..... F25J 1/0022 62/628
6,272,882 B1 * 8/2001 Hodges ..... F25J 1/0022 62/613

(Continued)

*Primary Examiner* — Brian M King
(74) *Attorney, Agent, or Firm* — Mintz Levin Cohn Ferris Glovsky and Popeo, P.C.

(57) ABSTRACT

Systems and methods are provided for adjusting a composition, pressure, and/or flow rate of a mixed refrigerant (MR) fluid in a liquefaction system to provide refrigeration to natural gas (NG) feedstock to produce liquefied natural gas (LNG). The MR fluid that is in circulation within a liquefaction system can include heavy components and light components. During LNG production, heavy components and/or light components of the MR fluid can be selectively removed from, and reintroduce into the MR fluid, thereby altering the composition of the remaining MR fluid in circulation. Adjusting the composition of the MR fluid in circulation within a liquefaction system can allow the system to be optimized to maximize efficiency, LNG production, and or profitability while the system is in operation.

27 Claims, 5 Drawing Sheets

(51) Int. Cl.
*F25B 9/00* (2006.01)
*F25B 45/00* (2006.01)

(52) U.S. Cl.
CPC ..... *F25J 2220/62* (2013.01); *F25J 2245/02* (2013.01); *F25J 2245/42* (2013.01); *F25J 2245/90* (2013.01)

(56) References Cited

U.S. PATENT DOCUMENTS

| | | | | |
|---|---|---|---|---|
| 2004/0255615 | A1* | 12/2004 | Hupkes | F25J 1/0022 62/606 |
| 2009/0071190 | A1* | 3/2009 | Potthoff | F25B 9/006 62/614 |
| 2014/0238076 | A1* | 8/2014 | Qualls | F25J 1/0022 62/630 |
| 2018/0128528 | A1* | 5/2018 | Chen | F25B 45/00 |

* cited by examiner

CONTINUOUS MIXED REFRIGERANT OPTIMIZATION SYSTEM FOR THE PRODUCTION OF LIQUEFIED NATURAL GAS (LNG)

CROSS-REFERENCE TO RELATED ACTIONS

This application claims priority to U.S. Provisional Application No. 62/472,694 filed on Mar. 17, 2017 and entitled "Continuous Mixed Refrigerant Optimization System for the Production of Liquefied Natural Gas (LNG)," and to U.S. Provisional Application No. 62/449,794 filed on Jan. 24, 2017 and entitled "Continuous Mixed Refrigerant Optimization System for the Production of Liquefied Natural Gas (LNG)", each of which is hereby incorporated by reference in its entirety.

BACKGROUND

Liquefied natural gas, referred to in abbreviated form as "LNG," is a natural gas which has been cooled to a temperature of approximately −162 degrees Celsius with a pressure of up to approximately 25 kPa (4 psig) and has thereby taken on a liquid state. Most natural gas sources are located a significant distance away from the end-consumers. One cost-effective method of transporting natural gas over long distances is to liquefy the natural gas and to transport it in tanker ships, also known as LNG-tankers. The liquid natural gas is transformed back into gaseous natural gas at the destination.

In a typical liquefaction process a compressor is used to deliver pressurized mixed refrigerant (MR) to a cold box, which in turn is used to cool a feed gas, such as a natural gas, to form a liquefied gas. Typically, LNG plants are designed to function optimally at one set of operating conditions, e.g., at one ambient temperature, and at one composition of natural gas (NG) feedstock. Altering the composition of the MR can change the optimal operating conditions of the plant, however, changes to the MR can only be made when the plant is shut down, e.g., on 6 to 12 month intervals. The MR composition is otherwise held constant during plant operation. Therefore, plants typically perform sub-optimally during the majority of their operation, which translates into reduced LNG production and/or increased costs. Accordingly, there is a need for methods and devices for modifying the optimal operating conditions of an LNG plant continuously.

SUMMARY

Systems and methods are provided for continuously modifying a composition of a mixed refrigerant (MR) fluid that circulates within a liquefaction system to produce liquefied natural gas (LNG). The MR fluid that is in circulation within a liquefaction system can include "heavy" components such as, e.g., pentane, butane, propane, ethylene, and "light" components such as, e.g., methane and nitrogen. The composition of the MR fluid can be adjusted by removing heavy components and/or light components of the MR from circulation. For example, during a compression and condensing process, heavy components within the MR fluid can condense prior to light components. Therefore, MR liquid, which can be rich in heavy components, can be separated from the MR fluid and removed from circulation, thereby altering a composition of the MR fluid that is in circulation. Similarly, MR vapor, which can be rich in light components, can be separated from the MR fluid and removed from circulation, thereby altering a composition of the MR fluid that is in circulation. In some cases, the heavy and light components can also be returned the MR fluid by reintroducing the MR liquid and/or the MR vapor back into circulation. By reintroducing and/or removing portions of the MR fluid (e.g., the MR liquid and/or MR vapor) to and from circulation, a pressure and/or flow rate of the MR fluid that circulates within the liquefaction system can be adjusted.

By providing the ability to continuously adjust the composition of a MR fluid in circulation within in a liquefaction system, the composition of the MR fluid can be optimized to maximize efficiency, LNG production, and or profitability of the liquefaction system while in operation.

DESCRIPTION OF DRAWINGS

These and other features will be more readily understood from the following detailed description taken in conjunction with the accompanying drawings, in which.

DETAILED DESCRIPTION

Systems and methods are provided for adjusting a composition of a mixed refrigerant (MR) fluid that can be used within a liquefaction system to provide refrigeration to methane-containing vapor, exemplified herein as a natural gas (NG) feedstock, to produce liquefied natural gas (LNG). The MR fluid that is in circulation within a liquefaction system can include heavy components and light components. During LNG production, MR liquid and MR vapor can be formed from the MR fluid in circulation. The MR liquid can be rich in heavy components relative to an averaged composition of the MR liquid and the MR vapor, and the MR vapor can be rich in light components relative to an averaged composition of the MR liquid and the MR vapor. The MR liquid and/or the MR vapor can be removed from circulation while the liquefaction system is in operation, thereby altering the composition, pressure, and/or flow rate of the remaining MR fluid in circulation. In some cases, the heavy and light components can also be returned the MR fluid by reintroducing the MR liquid and/or the MR vapor back into circulation. By reintroducing and/or removing portions of the MR fluid (e.g., the MR liquid and/or MR vapor) to and from circulation, a pressure and/or flow rate of the MR fluid that circulates within the liquefaction system can also be adjusted. By providing the ability to modify the composition, pressure, and/or flow rate of the MR fluid, the MR fluid can be optimized to maximize efficiency of the liquefaction system, thereby reducing operating costs, based on operating conditions such as, e.g., a temperature of ambient air. Alternatively, the composition, pressure, and/or flow rate of MR can be optimized to maximize LNG production or to maximize profitability.

Figure 1:
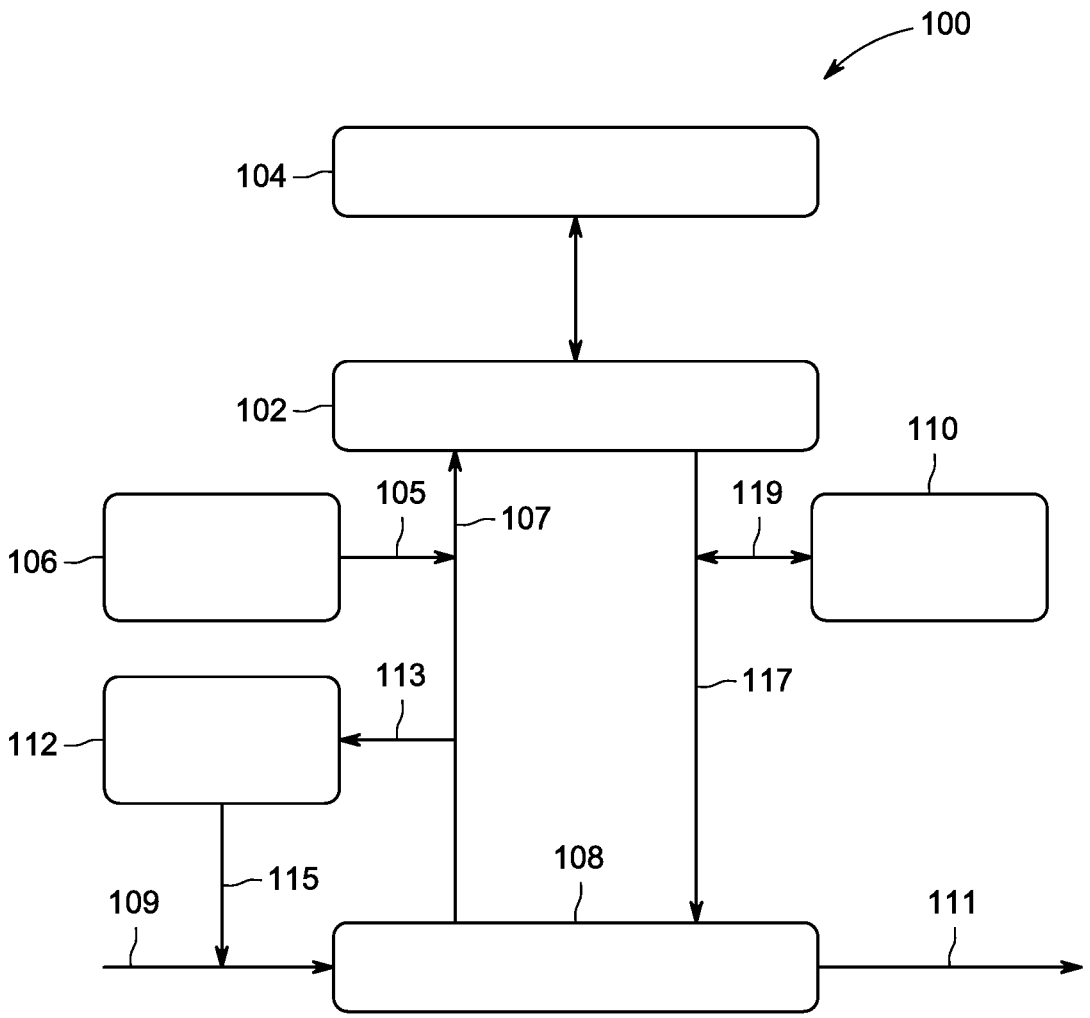
FIG. 1 is a diagram illustrating a liquefaction system of an LNG plant.

FIG. 1 shows a diagram of an embodiment of a liquefaction system 100 of an LNG plant. The liquefaction system 100 includes compressors 102 that pump refrigerant through the system, and air coolers 104 that can cool compressed refrigerant that is pumped through the system. An initial mixed refrigerant 105 makeup can be introduced to the system from a refrigerant supply system 106, and the liquefaction process can begin. Initially, low-pressure, low-temperature MR vapor 107 is delivered to the compressors. When the MR 117 leaves the compressors, it can be in a high-temperature, high-pressure, vapor state.

Condensers/intercoolers/aftercoolers (not shown) can be located between stages of the compressors and/or between the compressors and a cold box 108. The condensers/intercoolers aftercoolers can facilitate a phase change of the MR from vapor, or mostly vapor, to a predominantly liquid state by removing excess heat generated during the compression process. The liquid MR 117 is then delivered to the cold box 108 to cool incoming methane-containing vapor, exemplified herein as a natural gas (NG) feedstock 109. At some point prior to entering or within the cold box 108, the MR 117 can travel through an expansion valve, which can create a rapid pressure drop that can put the MR in a low-pressure, low-temperature, liquid state. Within the cold box 108, the NG feedstock 109 can travel over an evaporator or heat exchanger, which can cool the NG sufficiently to form LNG 111. At that point the incoming NG may heat the MR to a point where it can become predominantly a vapor, and the cycle continues.

If the liquefaction system is equipped for continuous mixed refrigerant optimization (CMRO), then heavy and light components of the MR can be added to, or removed from, the system during operation. As described above, current liquefaction systems are designed to operate with a constant MR composition that is optimized for a single set of operating conditions. Such liquefaction systems can be sensitive to variations in the ambient temperature and/or changes in the composition of the NG feedstock, both of which can have a significant impact on the efficiency of the system and the production of LNG. Thus, by providing the ability to modify the composition of the MR, the efficiency of the system can be increased, thereby reducing costs. Alternatively, the composition of MR can be optimized to maximize LNG production or to maximize profitability.

During the compression and condensing process, heavy components within the MR, e.g., butane, propane, ethylene, and i-pentane, can condense prior to light components such as methane and $N_2$. The heavy components of the MR can be extracted from, and/or added to, circulation within the liquefaction system 100. A portion 119 of the condensed heavy components can be separated from the MR, removed from the system, and stored in a heavy component storage vessel 110, as shown in FIG. 1. Similarly, the portion 119 of the condensed heavy components can be reintroduced into the system from heavy component storage vessel 110 as desired.

After the refrigerant leaves the cold box, it may be in a predominantly vapor state, where the vapor can primarily contain light components, e.g. methane and $N_2$. A portion 113 of the vapor can be separated from the liquid and other vapor, removed from the system, and stored in a light component storage vessel 112. Alternatively, a portion of the MR can be stored in a separate tank, where some equilibrium liquid/vapor combination can form. In that case, the vapor can primarily contain light components which can be separated from the remainder of the mixture. In either case, the light components 115 can be introduced into the NG feedstock 109 to increase the production of LNG, since methane is NG. Although not illustrated, the light components can also be reintroduced into the liquefaction system 100. By reintroducing and/or removing portions of the MR to and from the system, a pressure and/or flow rate of the MR that circulates within the liquefaction system 100 can also be adjusted.

Figure 2:
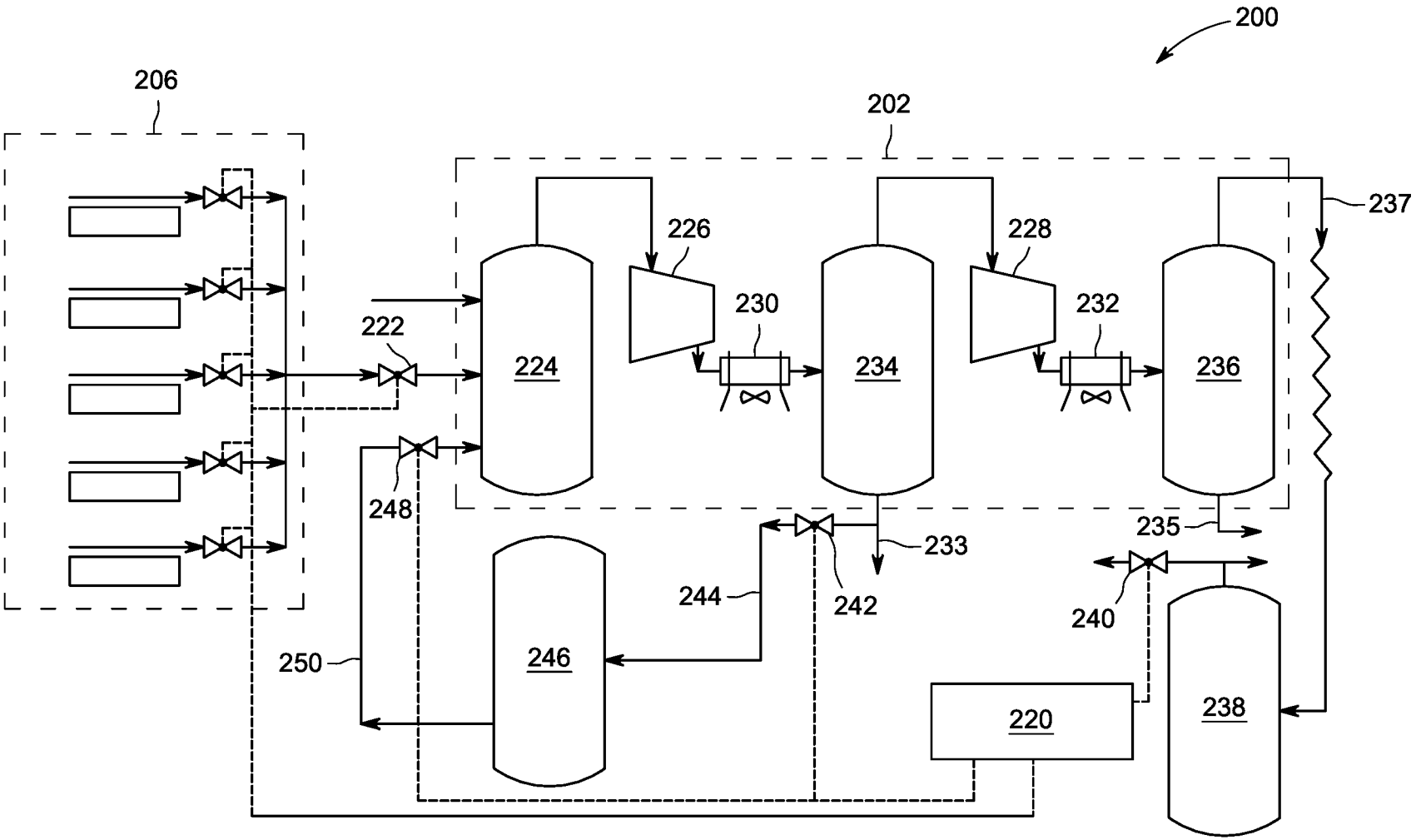
FIG. 2 is a diagram illustrating an example liquefaction system.

An exemplary liquefaction system 200 is illustrated in FIG. 2. A person skilled in the art will appreciate that an existing system can be modified to have a configuration similar to what is shown in FIG. 2. The liquefaction system 200 can include a refrigerant supply system 206 that can deliver MR to a multistage compression system 202 that can compress and condense the MR. The compressed and condensed MR can be delivered to a cold box (not shown) to provide refrigeration to an incoming NG feedstock (not shown) to produce LNG (not shown). The liquefaction system 200 can also include a control module 220 that can control a composition of the MR that is in circulation within the liquefaction system 200, as well as storage vessels 238, 246 for storing MR that has been removed from circulation.

As illustrated, refrigerant components can combine in the refrigerant supply system 206 to form a MR which flows into the multistage compression system 202. The composition of the MR that flows from the refrigerant supply system 206 can be controlled by a control module 220 which controls valves that regulate the flow of each component, as well as a valve 222 that can control the flow of MR to the multistage compressor system. The multistage compressor system can include a suction surge drum 224, as well as first and second stage compressors 226, 228, intercoolers 230, 232, and knockout drums 234, 236 (also referred to herein as a separator or two-phase separator). The knockout drums 234, 236 can separate liquid and vapor phases of the MR. In a traditional liquefaction system, refrigerant 233, 235, which can be primarily liquid, can flow from the first and second stage knockout drums 234, 236 to a cold box (not shown) to treat NG feedstock. Additionally, refrigerant 237, which can be vapor and/or liquid, can flow from the second stage knockout drum 236, through the cold box, to a MR storage vessel 238, where it can optionally be stored and/or introduced to the cold box to provide refrigeration, as desired. Alternatively, the refrigerant 237 can be removed from the system to be used as fuel, flared, and/or vented. The refrigerant can optionally be replaced when and as desired from alternative makeup flows such as, e.g., essentially pure MR components, natural gas, and/or LNG boil off gas.

If the liquefaction system is equipped for CMRO, then heavy and light components of the MR can be added to, or removed from, the system. Within the MR storage vessel 238, the MR can equilibrate to a mixture of liquid and vapor. The vapor can contain mostly light components. Therefore, a portion of the vapor can be extracted and introduced into NG feedstock that enters the cold box to be condensed to LNG. In FIG. 2, a lights storage valve 240 can be opened to allow the vapor refrigerant to flow from the MR storage vessel 238. The vapor that flows from the storage vessel 238 can be stored in another storage vessel, reintegrated into circulation within the liquefaction system 200, or delivered to a flare to be burned.

As described above, heavy components of MR can condense at higher temperatures than light components of MR. Therefore, MR liquid that can be rich in heavy components relative to an initial, or average, composition of the MR can be separated from MR vapor that can be rich in light components relative to an initial, or average, composition of MR. One skilled in the art will appreciate that MR liquid that is rich in heavy components is light, or lean, in light components. Similarly, MR vapor that is rich in light components, is lean, or light, in heavy components. Heavy components to be extracted from the MR at one or more locations within the multistage compression system 202 and/or at one or more locations between the multistage compression system 202 and the cold box. In the illustrated example, a heavies extraction valve 242 can be opened to extract MR fluid 244 that can be rich in heavy components, relative to an average composition of MR fluid that enters the first stage knockout drum 234, from the remaining MR in the first stage knockout drum. The MR fluid 244 can flow into a heavies storage vessel 246 where it can be stored. The MR fluid within the heavies storage vessel 246 can be maintained at a temperature and pressure such that it forms, or remains, liquid, an equilibrium liquid/vapor combination, or a vapor. In any case, a heavies storage valve 248 can be opened to deliver MR fluid, which can be a liquid and/or a vapor, from the heavies storage vessel 246 to the suction surge drum 224, where it can be reintroduce back into circulation such that it can provide refrigeration to NG to form LNG. The lights storage valve 240, heavies storage valve 248, and heavies extraction valve 242 can be controlled by the control module 220. In this way, the composition of the MR circulating within the liquefaction system 200 can be adjusted during normal operation based on external factors such as an ambient air temperature and composition of the NG feedstock to make the liquefaction system more efficient.

The control module 220 can be configured to optimize the composition of the MR automatically while the liquefaction system 200 is in operation. For example, the liquefaction system 200 can include sensors that can measure the ambient air temperature, the composition of incoming NG feedstock, the composition of the MR within the storage vessels 238, 246, and/or the composition of MR in circulation. Information from the sensors can be delivered to the control module 220 such that the composition of MR and/or flow of MR in circulation can be adjusted accordingly to increase efficiency of LNG production and/or increase volume of LNG production. Alternatively, the ambient temperature and composition of incoming NG feedstock can be entered by an operator, and the MR can subsequently by adjusted based on those values.

Figure 3:
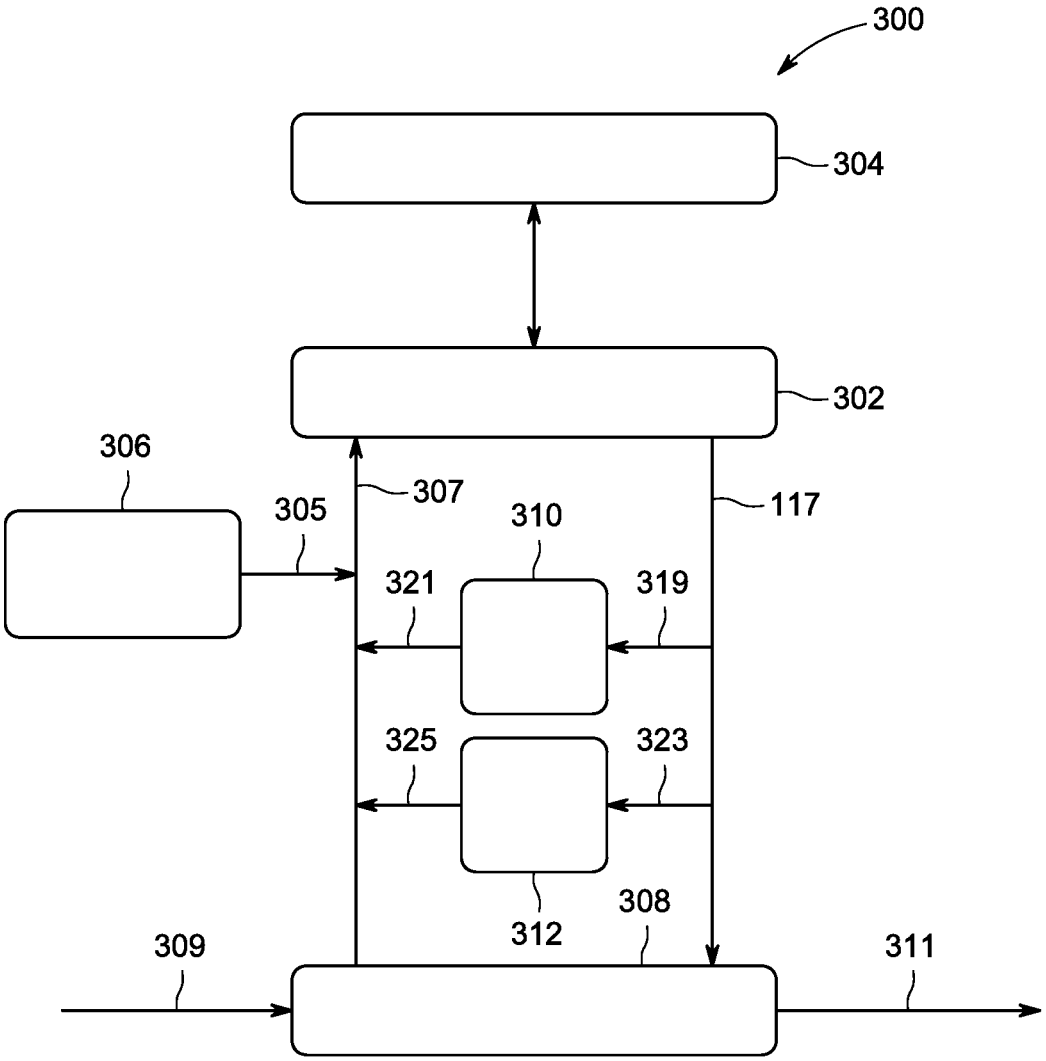
FIG. 3 is a diagram illustrating a closed loop liquefaction system of an LNG plant.

In some embodiments, a liquefaction system equipped for CMRO can be a closed loop system. FIG. 3 shows a diagram of an embodiment of a liquefaction system 300 of an LNG plant. The liquefaction system 300 can include compressors 302 to compress MR, air coolers 304 (or other coolers) to cool MR between stages of compression and/or after compression, and a cold box 308 to provide refrigeration to an incoming NG feedstock 309 to produce LNG 311. The system can also include a control module (not shown), as well as storage vessels 310, 312 for storing heavy and light components of the MR.

The liquefaction system 300 shown in FIG. 3 can generally be similar to the liquefaction system 100 shown in FIG. 1, except heavy and light components of MR can be separated from the MR in circulation in the liquefaction system 300. That is, heavy and light components can be removed from circulation in the refrigeration system and stored elsewhere, such as within the storage vessels 310, 312, within the liquefaction system, but, generally, those same components can be reintroduced into the system. Therefore, the liquefaction system 300 can be a closed loop system. A closed loop configuration can provide additional stability of control to the system by ensuring that heavy and light components of MR are readily available to be reintroduced to, or removed from, the refrigeration system.

Similar to the liquefaction system 100 described with regard to FIG. 1, the liquefaction system 300 shown in FIG. 3 shows that an initial mixed refrigerant 305 (MR) makeup can be introduced to the system from a refrigerant supply system 306, such that a liquefaction process can begin. Initially, low-pressure, low-temperature MR vapor 307 can be delivered to the compressors 302. When the MR 317 leaves the compressors 302, it can be in a high-temperature, high-pressure vapor state. Condensers/intercoolers/aftercoolers (not shown) can be located between stages of the compressors 302 and/or between the compressors 302 and the cold box 308. The condensers/intercoolers/aftercoolers can facilitate a phase change of a portion of the MR from vapor, or mostly vapor, to a predominantly liquid state by removing excess heat generated during the compression process. Alternatively, or additionally, the MR can be delivered to condensers, aftercoolers, or other heat exchangers that can be located downstream of the compressors 302. The liquid MR can then be delivered to the cold box 308 to cool incoming natural gas (NG) feedstock 309. At some point prior to entering the cold box, within the cold box, and/or upon exiting the cold box, the refrigerant can travel through an expansion valve, which can create a pressure drop that can put the MR in a low-pressure, low-temperature, liquid/vapor state. Within the cold box 308, the NG feedstock 309 can travel over an evaporator or heat exchanger, which can facilitate transferring heat from the NG feedstock 309 to cool the NG sufficiently to form LNG. At that point the incoming NG may heat the MR to a point where it can become predominantly a vapor, and the cycle continues.

If the liquefaction system 300 is equipped with a continuous mixed refrigerant optimization system (CMROS), then heavy and light components of the MR can be added to, or removed from, the refrigeration cycle during operation. That is, heavy and light components of the MR can be removed from circulation, and stored in storage vessels 310, 312. The heavy and light components can be reintroduced as desired. By reintroducing and/or removing portions of the MR (e.g., the heavy and/or light components) to and from circulation, a pressure and/or flow rate of the MR that circulates within the liquefaction system 300 can also be adjusted. As described above, current liquefaction systems are designed to operate with a constant MR composition that is optimized for a single set of operating conditions, e.g., the system can be designed to function optimally at a high ambient temperature, with some nominal incoming NG feedstock composition. Variations in the ambient temperature and changes in the composition of the NG feedstock can have a significant impact on the efficiency of the system and the production of LNG. Thus, by providing the ability to modify the composition, pressure, and/or flow rate of the MR, the efficiency of the system can be increased, thereby reducing costs, or the production of LNG can be increased.

During the compression and condensing process, heavy components within the MR, such as, e.g., pentane (e.g. i-pentane), butane, propane, ethylene, may condense prior to light components such as ethylene, methane and $N_2$. Intermediate boiling components may, in various portions, be considered to be both light and heavy, as exemplified by ethylene. A portion 319 of the condensed heavy components can be separated from the MR, and stored in the heavy component storage vessel 310, as shown in FIG. 3. Similarly, the portion 321 of heavy components can be reintroduced to the refrigeration system from the heavy component storage vessel 310 as desired.

After the compression and condensing process, light components within the MR, e.g., methane and $N_2$, can largely remain in a vapor state. Therefore, MR vapor can contain primarily light components. A portion 323 of the MR vapor can be stored in the light component storage vessel 312, as shown in FIG. 3. As another example, light components can be extracted from the refrigeration system and stored after the MR leaves the cold box. After the refrigerant leaves the cold box, it may be in a predominantly vapor state, where the vapor can contain primarily light components, e.g. methane and $N_2$. A portion of the vapor can be separated from the liquid and other vapor, and stored in the light component storage. Alternatively, a portion of the MR can be stored in a separate tank, where some equilibrium liquid/vapor combination can form. In that case, the vapor can contain primarily light components which can be separated from the remainder of the mixture. In either case, the portion 325 of MR containing light components can then be reintroduced to the refrigeration system as desired.

Figure 4:
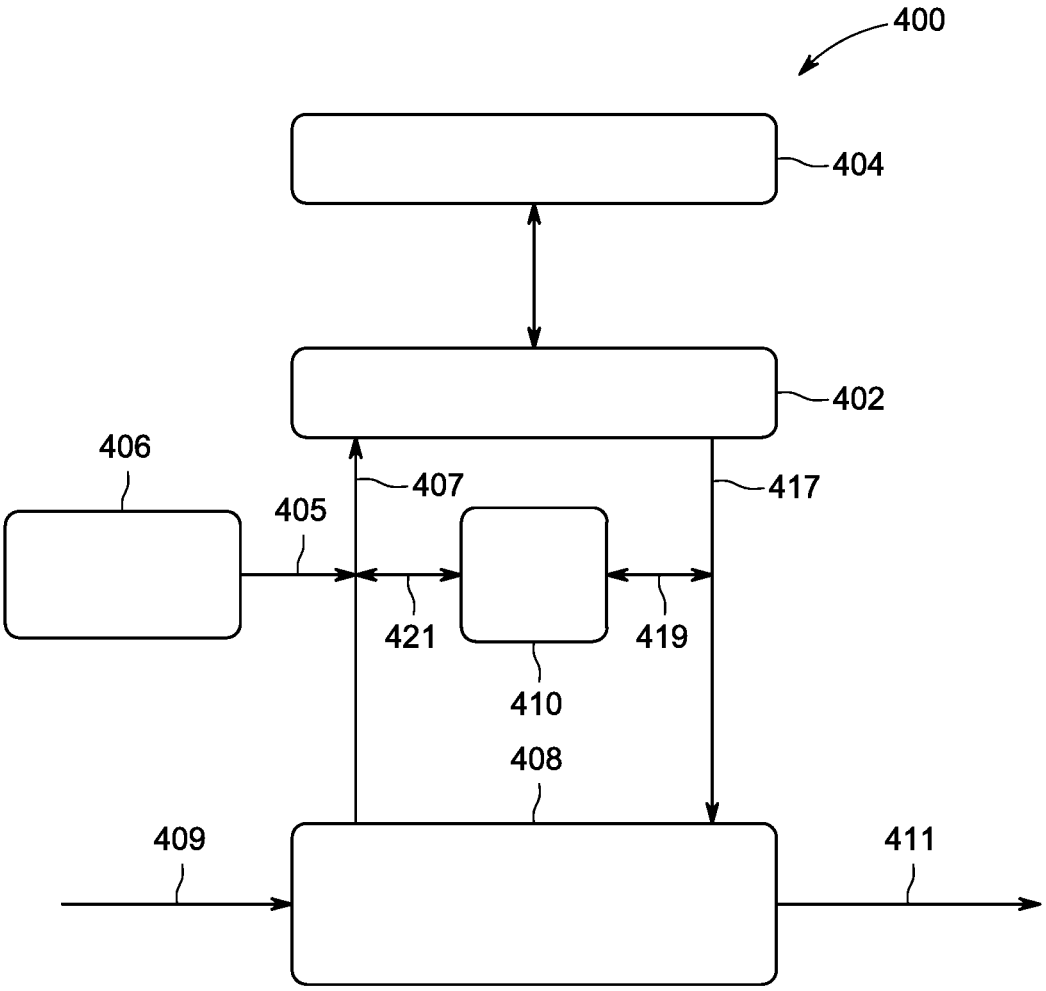
FIG. 4 is a diagram of an alternate embodiment of a liquefaction system of an LNG plant.

The heavy components and light components can be reintroduced into the system as desired. For example, heavy and light components can be reintroduced into the system via the cold box. Alternatively, heavy and light components can be reintroduced into the system prior to compression. FIG. 4 shows a diagram of an embodiment of a liquefaction system 400 of an LNG plant. The liquefaction system 400 can generally be similar to the liquefaction system 300 shown in FIG. 4, but can include a storage system 410 that can allow portions 419, 421 of MR, which can be rich heavy components and/or light components, to be removed from, and/or added to, circulation at various location between compressors 402 and a cold box 408. The liquefaction system 400 can include compressors 402 to compress MR, air coolers 404 (or other coolers) to cool MR between stages of compression and/or after compression, and a cold box 308 to provide refrigeration to an incoming NG feedstock 409 to produce LNG 411. The system can include a control module (not shown), as well as the storage system 410, which can include storage vessels for storing heavy and light components of the MR.

Figure 5:
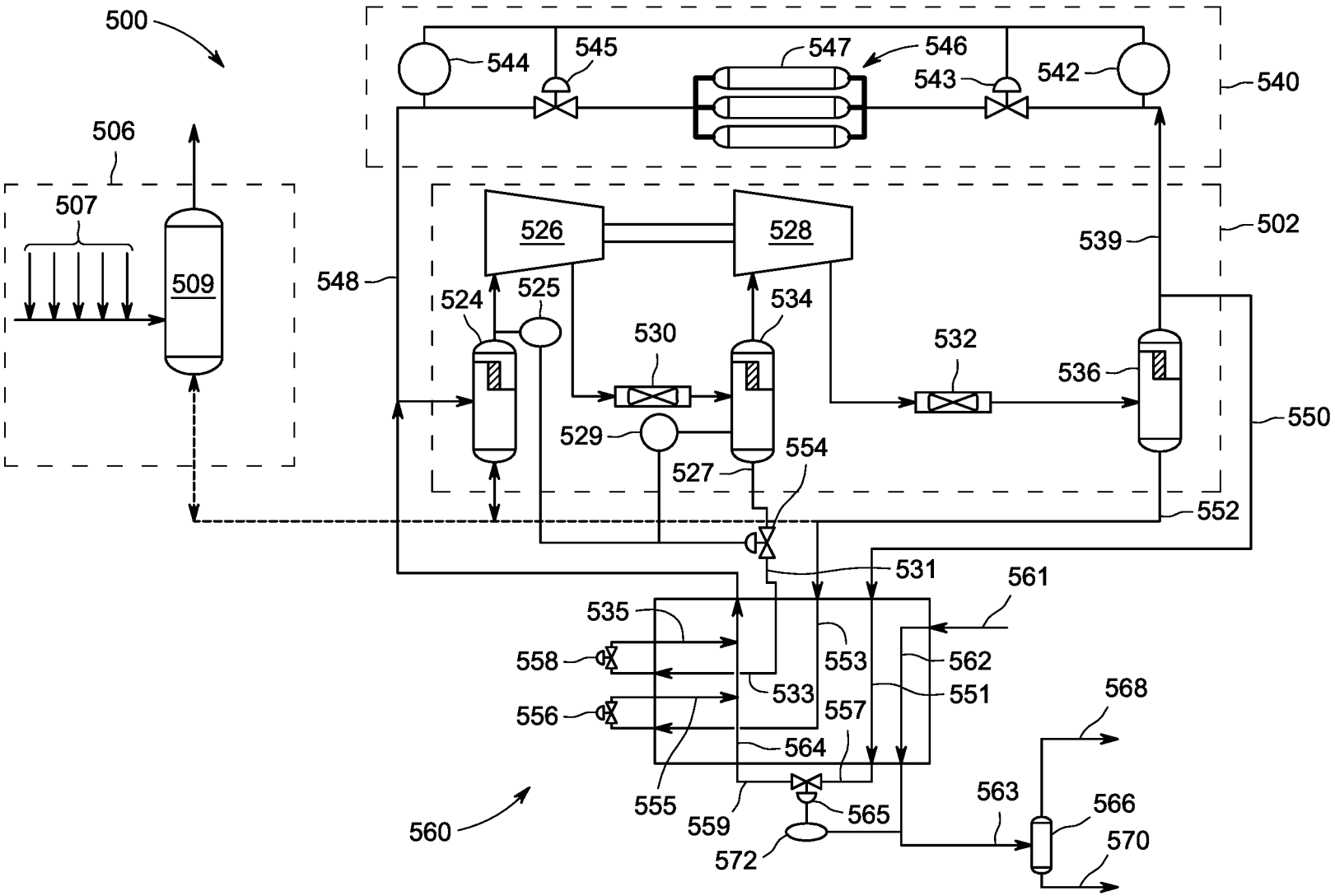
FIG. 5 is a diagram illustrating an example closed loop liquefaction system.

FIG. 5 shows an exemplary embodiment of a closed loop liquefaction system 500 that can optimize the composition of the MR automatically while the liquefaction system 500 is in operation. As shown in FIG. 5, the liquefaction system 500 can include a refrigerant supply system 506 that can be coupled to a multistage compression system 502. Mixed refrigerant can circulate between the multistage compression system 502 and a heat exchanger 560 to provide refrigeration to a natural gas feedstock 561 to produce LNG. In some embodiments, the system can include one or more sensors that can measure the ambient air temperature and/or the composition of incoming NG feedstock 561. The system can also include storage vessels that facilitate removal and reintroduction of heavy and light components of the MR to and from circulation. It is noted that one skilled in the art will have a basic understanding of how heat exchangers work, and will know that refrigerants can travel through cooling passages, cooling elements, or within a shell, to provide refrigeration to a "hot fluid" such as NG feedstock. As the NG and MR travel through the heat exchanger 560, heat can be transferred from the NG feedstock 561 to the MR such that the NG feedstock 561 begins to condense.

As illustrated, refrigerant components 507 such as nitrogen, methane, ethylene, propane, and i-pentane, can be combined in the refrigerant supply system 506 to form a MR fluid which can be delivered to a MR transfer drum 509. The MR fluid can be delivered from the MR transfer drum 509 to the multistage compression system. The composition of the MR that flows from the refrigerant supply system can be controlled by a control module which controls valves that regulate the flow of each component, as well as a valve that controls the flow of MR to the multistage compressor system. One skilled in the art will appreciate that other components of a mixed refrigerant can include normal-pentane, iso-butane, and normal-butane.

The multistage compressor system can include a suction surge drum 524, as well as first and second stage compressors, and air coolers. In the illustrated embodiment, MR can flow from the refrigerant supply system 506 to the suction surge drum 524. The MR can travel from the suction surge drum 524 to the first stage compressor 526. The composition of the MR, a characterizing parameter thereof, or combination of multiple measurements can be analyzed and used for control. For example, as shown in FIG. 5, between the suction surge drum 524 and the first stage compressor, an analyzer module 525 can measure the composition, phase, and/or pressure of the MR entering the first stage compressor 526. In some embodiments, the analyzer module 525 can be, or can include, a gas chromatograph. For example, the analyzer module 525 can measure the number of moles of carbon per mole of MR. Alternatively, the analyzer module 525 can measure the molecular weight of the MR, the pentane mole fraction of the MR, and/or a combination, e.g., sum, of MR mole fractions, or other parameter characterizing the MR. Accordingly the composition of the MR fluid can be measured, and/or characterized, by measuring individual components of the MR and/or by measuring or calculating combinations of individual components. The analyzer module 525 can adjust the composition of the MR that is delivered to the first stage compressor 526 based on other operating conditions. For example, the analyzer module 525 can control, can request, or can draw more refrigerant from the refrigerant supply system 506. Alternatively, the analyzer module 525 can control, can request, or can draw less refrigerant from the refrigerant supply system 506. Additionally, the analyzer module 525 can request or draw specific components of the MR from the refrigerant supply system 506. As another example, the analyzer module 525 can request, can control, or can draw a lack of specific components of MR from the refrigerant supply system. The analyzer module 525 can also control, or request, removal of portions, or components, of MR from circulation. Portions, or components, of MR that can be removed from circulation can be stored in storage vessels.

From the first stage compressor 526, the MR can be delivered to the first stage intercooler 530, where heat can be extracted. From the first stage intercooler 530, the MR can be delivered to a liquid storage vessel 534, which can also function as a first stage knockout drum, also referred to as a two-phase separator. As described above, during the compression and condensing process, heavy components within the MR, e.g., propane, ethylene, and i-pentane, may condense prior to light components such as methane and $N_2$. Therefore, the liquid storage vessel 534 can store MR liquid which can be rich in heavy components relative to an average composition of the MR that enters the liquid storage vessel 534, thereby removing heavy components from circulation, while diverting MR that is predominantly vapor to the second stage compressor. As shown in FIG. 5, the liquid storage vessel 534 can also divert MR liquid 527 to the heat exchanger 560, which will be discussed more below. By storing a MR liquid within the liquid storage vessel 534, a flow rate and/or pressure of MR that circulates within the liquefaction system 500 can be reduced.

A level module 529 can be connected to the liquid storage vessel 534. The level module 529 can determine how much liquid is in the liquid storage vessel 534, as well as determine the composition of the liquid, similar to the analyzer module 525 between the suction surge drum 524 and the first stage compressor 526. In some embodiments, the level module can be, or can include, for example, a level indicator (LI), a level controller (LC), a level indicator controller (LIC), and/or a sight glass.

In the illustrated example, the MR that is delivered to the second stage compressor 528 can be delivered to the second stage intercooler 532, and then to a second stage knockout drum 536. The second stage knockout drum 536 can separate MR liquid from MR vapor. In some embodiments, the knockout drum 536 can store at least a portion of the MR liquid that is separated from the MR vapor. As described above, during compression and condensation, heavy components can condense prior to light components. Therefore, MR vapor can be rich in light components, while the MR liquid can be rich in heavy components relative to an average composition of the MR that enters the second stage knockout drum 536. A portion of the MR vapor, which can be rich in light components relative to an average composition of the MR that enters the second stage knockout drum 536, can be delivered to a vapor storage system 540, thereby removing that portion of MR vapor from circulation and altering the composition of the MR that is in circulation. The vapor storage system 540 can include first and second pressure modules 542, 544, and valves 543, 545, as wells a storage vessel array 546. The storage vessel array 546 can include one or more storage vessels 547. In some embodiments, the first and second pressure modules 542, 544 can include one or more pressure sensors that can be configured to measure pressure of MR upstream of the first valve 543, and downstream of the second valve 545. The first pressure module 542 can control the first valve 543 to allow the MR vapor 539 to flow into the storage vessel array 546. Removing the MR vapor 539 from circulation can also reduce the pressure and/or flow rate of the MR in circulation. The second pressure module 544 can control the second valve 545 to allow MR stored in the storage vessel array 546 to flow back into circulation within the refrigeration system. When the second valve 545 is opened, MR fluid 548 can be delivered to the suction surge drum 524, and can continue through the multistage compression system 502. Reintroducing the MR fluid 548 into circulation can increase the pressure and/or flow rate of the MR in circulation within the liquefaction system 500. Pressure modules, exemplified by pressure modules 542, 544, can function to control an amount of MR vapor in circulation within the liquefaction system 500. The amount of MR vapor allowed to circulate within the liquefaction system 500 can be adjusted to maintain, or achieve, desired pressures, flow rates, and/or composition of MR circulating within liquefaction system 500, and to maintain surge control of the compressors. Therefore, the vapor storage system 540 can function to alter the composition of MR flowing between the multistage compression system 502 and the heat exchanger 560, as well as alter the pressure and/or flow rate of MR in circulation within the liquefaction system 500, thus providing stability of control to the liquefaction system 500.

Another portion of MR vapor 550, as well as MR liquid 552, from the second stage knockout drum 536 can be delivered to the heat exchanger. The heat exchanger 560 can receive NG feedstock 561, as well as MR liquid 552 and MR vapor 550, to produce an intermediate LNG 563. In addition to receiving the MR liquid 552 from the second stage knockout drum 536, the heat exchanger can receive MR liquid 527 from the liquid storage vessel 534 that is between the first stage intercooler 530 and the second stage compressor 528. The analyzer module 525 and/or the level module 529 can open a liquid reintroduction valve 554, which can allow MR liquid 531 from the liquid storage vessel 534 to be delivered to the heat exchanger. As described above, the analyzer module 525 can measure a composition of the MR. The analyzer module can compare the measured composition of the MR in circulation to a desired composition, and can open the liquid reintroduction valve 554 to allow the MR liquid 527 to be reintroduced to circulation, or close the liquid reintroduction valve 554 to accumulate MR liquid, which can be rich in heavy components, in the liquid storage vessel 534, thereby removing heavy components of the MR from circulation. The reintroduction of the MR liquid 527 into circulation can also function to increase the pressure and/or flow rate of the MR in circulation. Therefore, the liquid storage vessel 534 can function to alter the composition of MR flowing between the multistage compression system 502 and the heat exchanger 560, as well as alter the pressure of MR that is in circulation within the liquefaction system 500, thus providing stability control the system.

MR liquid 527, 552 from the liquid storage vessel 534 and/or the second stage knockout drum 536 can also be delivered to the MR transfer drum 509 in the refrigerant supply system 506, wherein the MR can be stored or discharged to a flare.

The heat exchanger 560 can be, e.g., a core plate-and-fin style heat exchanger. Alternatively, other heat exchangers such as a multi-pass plate fin brazed aluminum heat exchanger (BAHX), core, etched plate, diffusion bonded, wound coil, shell and tube, plate-and-frame, etc. can be used. However, the general design of a core plate-and-fin style heat exchanger can be easily configurable to enable multiple pressure passes in a wide variety of heat transfer configurations. The MR vapor 551, which can be rich in light components, and the MR liquids 553, 533, which can be rich in heavy components, can travel through cooling passages and/or cooling elements within the heat exchanger 560 to provide refrigeration to incoming NG feedstock 561. As the NG feedstock 562 travels through the heat exchanger, it can transfer heat to the MR vapor 551 and/or the MR liquids 553, 533 such that the NG feedstock 562 can condense to form the intermediate LNG 563.

As illustrated in FIG. 5, MR vapor 557 can travel through a let-down valve 565 as it circulates through the heat exchanger 560. The let-down valve 565 can create a drop in the pressure of the MR vapor 557, which can reduce the temperature of the MR vapor 557, thus ensuring that it remains sufficiently cold to cool the NG feedstock 562 to produce the intermediate LNG 563. In the illustrated embodiment, MR vapor 559 that flows back into the heat exchanger 560 can function to provide refrigeration to the MR vapor 551 and/or MR liquids 553, 533, as well as to the NG feedstock 562. Although one let-down valve 565 is illustrated, the MR can travel through multiple let-down valves prior to leaving the heat exchanger 560 to be delivered to a multistage compression system 502.

The MR liquids 553, 533 can be passed through first and second reintroduction valves 556, 558, which can reduce the pressures of the MR liquids 553, 533. The reduction in pressure can allow the MR liquids 555, 535 to be combined with the MR vapor 564 that has been returned to the heat exchanger 560. Combining the MR liquids 555, 535 with the MR vapor 564 can increase the flow rate and/or alter the composition of the MR traveling within the heat exchanger 560.

NG feedstock can often contain heavy hydrocarbon components (HHCs), and it can be desirable to remove HHCs during production to prevent them from freezing at typical LNG production temperatures. Although not illustrated, the heat exchanger 560 can include a HHC separation system that facilitates removing HHCs. As the NG feedstock is cooled within the heat exchanger, HHCs can condense at higher temperatures than lighter molecules such as, e.g., methane. Therefore, liquid containing HHCs can be separated from the remaining NG vapor within the HHC separation system, and optionally stored in a HHC storage vessel. The HHC liquid can be stored in a HHC storage vessel, or delivered to a HHC distillation system, which can in include a reboiler, where it can be separated into its constituent components. The remaining NG vapor can be reintroduce to the heat exchanger 560 and can continue through the heat exchanger 560 and condense to form the intermediate LNG 563.

Upon exiting the heat exchanger 560, the intermediate LNG 563 can optionally be reduced in pressure (e.g., across a valve, not shown) and can generate some flash gas. The intermediate LNG 563 that exits the heat exchanger can be delivered to a flash drum 566, which can separate the flash gas 568 from LNG product 570. Although not required, a temperature of the intermediate LNG 563 can be monitored with a temperature module 572 which can control the let-down valve 565 that the MR vapor 557 travels through. By altering the pressure drop across the let-down valve 565, the temperature of the MR vapor 559 can be altered, and therefore the temperature of the intermediate LNG 563 can be controlled. In some embodiments, the flash gas 568, which can be rich in nitrogen and/or methane, can be captured and can be reintroduced into the liquefaction system 500 as one or more refrigerant components 507 to alter the composition of the MR in circulation. Alternatively, or additionally, boil-off gas from the LNG product 570 (e.g., from cryogenic storage), which can primarily include methane, can be reintroduced into the liquefaction system 500 as one or more of the refrigerant components 507 to alter the composition of the MR in circulation.

The liquefaction system 500 can include a control module (not shown) that can include, communicate with, and/or control the analyzer module 525, the level module 529, the liquid reintroduction valve 554, the first and second pressure module 542, 544, the first and second valves, 543, 544, the let-down valve 565, the temperature module 572, and the refrigerant supply system 506, including the MR transfer drum 509. Therefore, the control module can monitor certain parameters associated with the liquefaction system 500, and control the pressure and composition of MR that is used to provide refrigeration to incoming NG feedstock 561. In some embodiments, a control function for a desired MR composition, or relationships between measured input variables and a desired MR composition, can be control logic that can be implemented using, e.g., proportional-integral-derivative (PID) controller(s), or it can be based on simple linear relationships, multi-variable control relationships, physics-based model relationships, data-based or data-driven analytical models, learning relationships that can be determined and/or implemented using, e.g., artificial neural networks, or other methods or models such as, e.g., mathematical, analytical, digital, and analog relationships or functions.

In some embodiments, the liquefaction system 500, or certain components of the liquefaction system 500, can be coupled to a cloud platform (which can include one or more remote servers) such that data can be sent back and forth between the liquefaction system 500 and the cloud platform. For example, the level module 529, the first and second pressure module 542, 544, the temperature module 572, and the refrigerant supply system 506, including the MR transfer drum 509, can send measured, or calculated, data to the cloud platform, and can receive data from the cloud platform, using bi-directional communication. Bi-directional communication between the liquefaction system 500 and the cloud platform can allow for data collection (e.g., operational parameter information), collaboration and centralized asset management, and the ability to monitor a state and health of the liquefaction system 500 from the cloud. In addition, the bi-directional communication can allow for remote control of operational parameters such as, e.g., the desired MR composition as a function of ambient temperature.

In some cases, multiple liquefaction systems can be connected to the cloud platform. In such cases, data from various components of each of the liquefaction systems can be delivered to the cloud platform and comparative metrics (e.g. relative to other similar systems) can be used to determine which system is operating most efficiently, maximizing production most effectively, and/or maximize profitability most effectively. The cloud platform can perform system wide analytics and/or analytics across multiple liquefaction systems (e.g., so as to optimize the system wide performance). For example, a liquefaction system that is determined to operate more efficiently than other liquefaction systems can be preferentially operated over the liquefactions systems that operate less efficiently. As another example, comparative analysis can also be used to identify potential problems, failures, and/or areas to potentially improve operational performance of a liquefaction facility. In some cases, the cloud platform can utilize one or more artificial neural networks to conduct comparative analyses.

The bi-directional communication can be based on a combination of software components that utilize messaging systems and web socket protocol. The cloud platform side of the bi-directional communication can utilize a cloud platform technology stack. An application in the cloud can utilize 'Channel Provider' APIs to send the required command to one or more liquefaction systems, or components of the liquefaction systems, which can implement virtual I/O channels between the components of the liquefaction systems and the cloud using web sockets application protocol (e.g., standard outbound ports 80 and 443). Secure socket layer (SSL) encryption can ensure end-to-end security. The bi-directional connectivity can allow the liquefaction systems to avoid opening a listening port on the liquefaction system thereby allowing the bi-directional communication to maintain a high level of security.

Each of the valves mentioned above with regard FIGS. 1-5 can be considered to be a let-down valve, or a flash valve. Additionally, each of the illustrated embodiments is intended to be a non-limiting example. For example, in FIG. 5, the intermediate LNG can travel through a number of let-down valves a flash drums prior to a final LNG product being stored in a low pressure storage container. Similarly, one skilled in the art will understand that the subject matter described herein is not limited to the specific embodiments described above. For example, a closed loop liquefaction system, such as that shown in FIG. 5, can include multiple liquid storage vessels. The storage vessels can be located between the first stage compressor and intercooler, as well as between the second stage compressor and intercooler. As another example, the compression system can include one or more stages.

In some embodiments, a primary input control variable can be an ambient air temperature. The ambient air temperature can be used to control a composition of MR that is used to provide refrigeration to NG feedstock to produce LNG. As another example, the ambient air temperature can be used to control the flow rate and/or pressure of the MR that is used to provide refrigeration to NG feedstock to produce LNG. A composition of the NG feedstock can be a secondary control input. The composition of the NG feedstock can be used to control a composition of the MR that is used to provide refrigeration to the NG feedstock to produce LNG. As another example, the composition of the NG feedstock can be used to control the flow rate and/or pressure of the MR that is used to provide refrigeration to NG feedstock to produce LNG. In other embodiments, optimization of the MR composition can be implemented in open loop advisory control such that operator intervention can be utilized. An advisory control system can advise an operator of multiple production optimization options such as, e.g., maximize production, minimize power consumption, and/or maximize profitability. Operator intervention can provide system stability during liquefaction such as, e.g., during startup, during early implementation of a CMROS, and/or during times of dynamic changing market pricing and demand. MR optimization can be extended beyond processes related to economic and market optimization. For example, MR optimization can include metric that can characterize supply/demand, price of inputs such as, e.g. power, NG feedstock, and outputs such as, e.g., LNG product, liquefied petroleum gas (LPG), and natural gas liquids (NGLs).

Exemplary technical effects of the methods, systems, and devices described herein include, by way of non-limiting example, the ability to continuously adjust the composition and/or flow rate of a mixed refrigerant in a liquefaction process to maximize efficiency, maximize production, and/or maximize profitability.

One skilled in the art will appreciate further features and advantages of the subject matter described herein based on the above-described embodiments. Accordingly, the present application is not to be limited specifically by what has been particularly shown and described. All publications and references cited herein are expressly incorporated herein by reference in their entirety.

Other embodiments are within the scope and spirit of the disclosed subject matter.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it is used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." In addition, use of the term "based on," above and in the claims is intended to mean, "based at least in part on," such that an unrecited feature or element is also permissible.

The subject matter described herein can be implemented in digital electronic circuitry, or in computer software, firmware, or hardware, including the structural means disclosed in this specification and structural equivalents thereof, or in combinations of them. The subject matter described herein can be implemented as one or more computer program products, such as one or more computer programs tangibly embodied in an information carrier (e.g., in a machine-readable storage device), or embodied in a propagated signal, for execution by, or to control the operation of, data processing apparatus (e.g., a programmable processor, a computer, or multiple computers). A computer program (also known as a program, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub-programs, or portions of code). A computer program can be deployed to be executed on one computer or on multiple computers at one site or distributed across multiple sites and interconnected by a communication network.

The processes and logic flows described in this specification, including the method steps of the subject matter described herein, can be performed by one or more programmable processors executing one or more computer programs to perform functions of the subject matter described herein by operating on input data and generating output. The processes and logic flows can also be performed by, and apparatus of the subject matter described herein can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processor of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, (e.g., EPROM, EEPROM, and flash memory devices); magnetic disks, (e.g., internal hard disks or removable disks); magneto-optical disks; and optical disks (e.g., CD and DVD disks). The processor and the memory can be supplemented by, or incorporated in, special purpose logic circuitry.

To provide for interaction with a user, the subject matter described herein can be implemented on a computer having a display device, e.g., a CRT (cathode ray tube) or LCD (liquid crystal display) monitor, for displaying information to the user and an input device such as, e.g., a keyboard and/or a pointing device, (e.g., a mouse or a trackball), by which the user can provide input to the computer. Other kinds of devices can be used to provide for interaction with a user as well. For example, feedback provided to the user can be any form of sensory feedback, (e.g., visual feedback, auditory feedback, or tactile feedback), and input from the user can be received in any form, including acoustic, speech, or tactile input.

The techniques described herein can be implemented using one or more modules. As used herein, the term "module" refers to computing software, firmware, hardware, and/or various combinations thereof. At a minimum, however, modules are not to be interpreted as software that is not implemented on hardware, firmware, or recorded on a non-transitory processor readable recordable storage medium (i.e., modules are not software per se). Indeed "module" is to be interpreted to always include at least some physical, non-transitory hardware such as a part of a processor or computer. Two different modules can share the same physical hardware (e.g., two different modules can use the same processor and network interface). The modules described herein can be combined, integrated, separated, and/or duplicated to support various applications. Also, a function described herein as being performed at a particular module can be performed at one or more other modules and/or by one or more other devices instead of or in addition to the function performed at the particular module. Further, the modules can be implemented across multiple devices and/or other components local or remote to one another. Additionally, the modules can be moved from one device and added to another device, and/or can be included in both devices.

The subject matter described herein can be implemented in a computing system that includes a back-end component (e.g., a data server), a middleware component (e.g., an application server), or a front-end component (e.g., a client computer having a graphical user interface or a web browser through which a user can interact with an implementation of the subject matter described herein), or any combination of such back-end, middleware, and front-end components. The components of the system can be interconnected by any form or medium of digital data communication, e.g., a communication network. Examples of communication networks include a local area network ("LAN") and a wide area network ("WAN"), e.g., the Internet.

Approximating language, as used herein throughout the specification and claims, may be applied to modify any quantitative representation that could permissibly vary without resulting in a change in the basic function to which it is related. Accordingly, a value modified by a term or terms, such as "about" and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

One skilled in the art will appreciate further features and advantages of the invention based on the above-described embodiments. Accordingly, the invention is not to be limited by what has been particularly shown and described, except as indicated by the appended claims.

Embodiments of the invention may be described in the following exemplary clauses, which may be combined in any fashion unless otherwise noted:

In one embodiment, a liquefaction system is provided and is configured to selectively adjust a composition of a mixed refrigerant (MR) fluid in circulation therein. The system can include a condenser configured to condense at least a portion of the MR fluid to form a liquid-vapor mixture comprising a liquid rich in heavy components and a vapor light in heavy components. The system can also include a separator configured to receive the liquid-vapor mixture from the condenser, and to remove from circulation at least a portion of one of the liquid and the vapor from the first liquid-vapor mixture to thereby adjust the composition of the MR fluid that is in circulation. The system can further include a heat exchanger configured to receive the MR fluid that is in circulation, and configured to receive a methane-containing vapor such that heat can be transferred from the methane-containing vapor to the MR fluid to thereby condense the methane-containing vapor into a liquefied natural gas (LNG).

The system can have a variety of configurations. In one embodiment, the separator can be configured to store the at least a portion of the liquid and/or vapor that is removed from the liquid-vapor mixture. In other embodiments, the separator can be configured to reintroduce the stored liquid and/or vapor back into the MR fluid in circulation, thereby adjusting the composition of the MR fluid that is in circulation within the liquefaction system.

The system can include other components, such as a level module coupled to the separator. The level module can be configured to determine an amount of the liquid and/or vapor stored in the separator and to control an amount of the liquid and/or the vapor that is reintroduced back into circulation from the separator. The system can include an analyzer module configured to measure a composition of the MR fluid that is in circulation within the liquefaction system.

The system can include any number of condensers and separators. In one embodiment, the separator can be a first separator and a second separator. The first separator can be configured to remove from circulation the liquid from the first liquid-vapor mixture, and the second separator can be configured to remove from circulation the vapor from the first liquid-vapor mixture. The system can include a liquid storage system and/or a vapor storage system configured to receive and to selectively store at least a portion of the liquid and/or vapor, respectively, that is removed from the liquid-vapor mixture. The liquid and/or vapor storage systems can be configured to reintroduce at least a portion of the stored liquid and/or vapor into the MR fluid in circulation, thereby adjusting the composition of the MR fluid that is in circulation within the liquefaction system.

In other embodiments, a system for producing liquefied natural gas (LNG) is provided and includes a liquefaction system having a mixed refrigerant (MR) circulating therethrough. The liquefaction system can have at least one condenser and at least one separator configured to condense at least a portion of the MR fluid to form a MR liquid that is rich in heavy components of the MR fluid and a MR vapor that is light in components of the MR fluid, and to separate and remove at least one of the MR liquid and the MR vapor from circulation thereby adjusting a composition of the MR fluid in circulation. The liquefaction system can also have a heat exchanger configured to receive the MR fluid that is in circulation. The heat exchanger can be configured to receive a methane-containing vapor such that heat can be transferred from the methane-containing vapor to the MR fluid to thereby condense the methane-containing vapor into a liquefied natural gas.

In one embodiment, the liquefaction system can be configured to selectively deliver at least one of the MR liquid and the MR vapor back into the MR fluid in circulation to adjust the composition of the MR fluid. In certain aspects, the liquefaction system can be configured to adjust the composition of the MR fluid based on a temperature of ambient air. In other aspects, the liquefaction system is configured to adjust the composition of the MR fluid based on a composition of the methane-containing vapor.

In other embodiments, the heat exchanger can be configured to receive at least a portion of the MR liquid and to use the MR liquid to provide refrigeration to the methane-containing vapor.

In certain exemplary embodiments, the liquefaction system is configured to store the MR liquid and/or the MR vapor that are separated and removed from the MR fluid in circulation, and to selectively deliver at least one of the MR liquid and/or the MR vapor back into the MR fluid in circulation to adjust the composition of the MR fluid.

In other embodiments, the heat exchanger can be a multi-pass plate fin brazed aluminum heat exchanger.

The system can also include at least one level module coupled to the at least one separator. The at least one level module can be configured to control an amount of the at least one of the MR liquid and the MR vapor that is selectively delivered back into the MR fluid in circulation to adjust the composition of the MR fluid.

In another embodiment, a method for adjusting composition of a mixed refrigerant in a liquefaction system is provided. The method can include circulating a mixed refrigerant (MR) fluid within a liquefaction system, and creating a MR liquid and a MR vapor from the MR fluid. The MR liquid can be rich in heavy components of the MR fluid, and the MR vapor can be rich in light components of the MR fluid, relative to an initial composition of the MR fluid. The method can further include separating and removing at least a portion of at least one of the MR liquid and the MR vapor from the MR fluid, thereby adjusting a composition of the MR fluid that is circulating within the liquefaction system.

In one embodiment, the method can include adjusting the composition of the MR fluid by returning at least a portion of the separated and removed MR liquid and/or MR vapor back into circulation.

The method can also include measuring a temperature of ambient air to determine a desired composition of the MR fluid that is circulation within the liquefaction system. In one aspect, the method can include measuring a composition of methane-containing vapor to determine a desired composition of the MR fluid that is in circulation within the liquefaction system. In other aspects, the method can include measuring a composition of the mixed refrigerant fluid. The method can further include transmitting data that characterizes the measured composition of the mixed refrigerant to a remote server. In some implementations data can be compared against data from similar liquefaction systems. In other implementations, the remote server can deliver a signal to the liquefaction system.

In another embodiment, the method can include storing the at least a portion of at least one of the MR liquid and the MR vapor. The method can further include determining an amount of stored MR liquid and/or the MR vapor.

Certain exemplary embodiments are described to provide an overall understanding of the principles of the structure, function, manufacture, and use of the systems, devices, and methods disclosed herein. One or more examples of these embodiments are illustrated in the accompanying drawings. Those skilled in the art will understand that the systems, devices, and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention. Further, in the present disclosure, like-named components of the embodiments generally have similar features, and thus within a particular embodiment each feature of each like-named component is not necessarily fully elaborated upon.

What is claimed:

1. A system for producing liquefied natural gas (LNG), the system comprising:

a liquefaction system configured to selectively adjust a composition of a mixed refrigerant (MR) fluid in circulation therein, the system having a first condenser configured to condense at least a portion of the MR fluid received from a first compressor to form a liquid-vapor mixture comprising a liquid rich in heavy components and a vapor light in heavy components, a first separator configured to receive the liquid-vapor mixture from the first condenser, and to remove from circulation the liquid from the liquid-vapor mixture to thereby adjust the composition of the MR fluid that is in circulation, a second condenser configured to receive the liquid-vapor mixture from the first separator and to condense at least a portion of the MR fluid to form a liquid-vapor mixture comprising a liquid rich in heavy components and a vapor rich in light components, a second separator configured to receive the liquid-vapor mixture from the second condenser, and to remove from circulation a portion of the vapor from the liquid-vapor mixture, a vapor storage system coupled to the second separator and configured to receive and selectively store at least the portion of the vapor that is removed from the liquid-vapor mixture, the vapor storage system including a first pressure module configured to control a first valve, a second pressure module configured to control a second valve, and a storage vessel array including one or more storage vessels, and a heat exchanger configured to receive the MR fluid that is in circulation, and configured to receive a methane-containing vapor such that heat can be transferred from the methane-containing vapor to the MR fluid to thereby condense the methane-containing vapor into a liquefied natural gas (LNG).

2. The system of claim 1, wherein the first separator is configured to store the at least a portion of one of the liquid and the vapor that is removed from the liquid-vapor mixture.

3. The system of claim 1, wherein the first separator is configured to reintroduce the at least a portion of one of the liquid and the vapor that is removed from the liquid-vapor mixture back into the MR fluid in circulation, thereby adjusting the composition of the MR fluid that is in circulation within the liquefaction system.

4. The system of claim 2, further comprising:

a level module coupled to the first separator, the level module being configured to determine an amount of the at least a portion of one of the liquid and the vapor stored in the first separator and to control an amount of the at least a portion of one of the liquid and the vapor that is reintroduced back into circulation from the first separator.

5. The system of claim 1, wherein the vapor storage system is configured to reintroduce at least a portion of the stored vapor from the storage vessel array into the MR fluid in circulation, thereby adjusting the composition of the MR fluid that is in circulation within the liquefaction system.

6. The system of claim 1, further comprising:

an analyzer module configured to measure a composition of the MR fluid that is in circulation within the liquefaction system and is entering the first compressor.

7. A system for producing liquefied natural gas (LNG), the system comprising:

a liquefaction system configured to have a mixed refrigerant (MR) circulating therethrough, the liquefaction system having a first condenser configured to condense at least a portion of the MR fluid to form a MR liquid that is rich in heavy components of the MR fluid and a MR vapor that is light in heavy components of the MR fluid, a first separator configured to receive the MR liquid from the first condenser, and remove the MR liquid from the MR fluid in circulation thereby adjusting a composition of the MR fluid in circulation, a second condenser configured to receive the liquid-vapor mixture from the first separator and to condense at least a portion of the MR fluid to form a liquid-vapor mixture comprising a liquid rich in heavy components and a vapor rich in light components, a second separator configured to receive the liquid-vapor mixture from the second condenser, and to remove from circulation a portion of the vapor from the liquid-vapor mixture, a vapor storage system coupled to the second separator and configured to receive and selectively store at least the portion of the MR vapor that is removed from the MR fluid, the vapor storage system including a first pressure module configured to control a first valve, a second pressure module configured to control a second valve, and a storage vessel array including one or more storage vessels, and a heat exchanger configured to receive the MR fluid that is in circulation, and to receive a methane-containing vapor such that heat can be transferred from the methane-containing vapor to the MR fluid to thereby condense the methane-containing vapor into a liquefied natural gas.

8. The system of claim 7, wherein the liquefaction system is configured to selectively deliver at least one of the MR liquid and the MR vapor back into the MR fluid in circulation to adjust the composition of the MR fluid.

9. The system of claim 7, wherein the liquefaction system is configured to adjust the composition of the MR fluid based on a temperature of ambient air.

10. The system of claim 7, wherein the liquefaction system is configured to adjust the composition of the MR fluid based on a composition of the methane-containing vapor.

11. The system of claim 7, wherein the heat exchanger is configured to receive at least a portion of the MR liquid and to use the MR liquid to provide refrigeration to the methane-containing vapor.

12. The system of claim 7, wherein the liquefaction system is configured to store the at least one of the MR liquid and the MR vapor that are separated and removed from the MR fluid in circulation, and to selectively deliver the at least one of the MR liquid and MR vapor back into the MR fluid in circulation to adjust the composition of the MR fluid.

13. The system of claim 7, wherein the heat exchanger is a multi-pass plate fin brazed aluminum heat exchanger.

14. The system of claim 8, further comprising:

at least one level module coupled to the first separator, the at least one level module being configured to control an amount of the at least one of the MR liquid and the MR vapor that is selectively delivered back into the MR fluid in circulation from the first separator to adjust the composition of the MR fluid.

15. A method for adjusting composition of a mixed refrigerant in a liquefaction system, the method comprising:

circulating a mixed refrigerant (MR) fluid within a liquefaction system;

creating, via a first condenser, a MR liquid and a MR vapor from the MR fluid, the MR liquid being rich in heavy components of the MR fluid, and the MR vapor being rich in light components of the MR fluid, relative to an initial composition of the MR fluid;

separating, via a first separator, the MR liquid received from the first condenser thereby removing the MR liquid from the MR fluid in circulation and adjusting a composition of the MR fluid that is circulating within the liquefaction system, creating, via a second condenser, a MR liquid and a MR vapor from the MR fluid, the MR liquid being rich in heavy components of the MR fluid, and the MR vapor being rich in light components of the MR fluid, relative to a composition of the MR fluid output from the first separator;

separating, via a second separator, the MR vapor received from a second condenser, thereby removing the MR vapor from the MR fluid in circulation and adjusting a composition of the MR fluid that is circulating within the liquefaction system, and storing, via a vapor storage system coupled to the second separator, at least a portion of the MR vapor that is removed from the MR fluid, the vapor storage system configured to receive and selectively store at least the portion of the MR vapor that is removed from the MR fluid, the vapor storage system including a first pressure module configured to control a first valve, a second pressure module configured to control a second valve, and a storage vessel array including one or more storage vessels.

16. The method of claim 15, further comprising adjusting the composition of the MR fluid by returning at least a portion of at least one of the separated and removed MR liquid and the MR vapor back into circulation.

17. The method of claim 15, further comprising:

measuring a temperature of ambient air to determine a desired composition of the MR fluid that is in circulation within the liquefaction system.

18. The method of claim 15, further comprising:

measuring a composition of methane-containing vapor to determine a desired composition of the MR fluid that is in circulation within the liquefaction system.

19. The method of claim 15, further comprising:

measuring a composition of the MR fluid.

20. The method of claim 19, further comprising:

transmitting data that characterizes the measured composition of the MR to a remote server.

21. The method of claim 20, wherein the data is compared against data from similar liquefaction systems.

22. The method of claim 20, wherein the remote server delivers a signal to the liquefaction system.

23. The method of claim 15, further comprising:

storing the at least a portion of at least one of the MR liquid and the MR vapor.

24. The method of claim 23, further comprising:

determining an amount of the at least a portion of at least one of the MR liquid and the MR vapor that is stored.

25. The system of claim 1, wherein the first and second pressure modules include one or more pressure sensors configured to measure a pressure of the portion of the vapor that is removed from the liquid-vapor mixture, and wherein the first and second pressure modules further include computer-readable instructions, which when executed, configure the first and/or second pressure modules to respectively control the first and/or second valves configured in relation to the storage vessel array to cause the portion of the vapor that is removed from the liquid-vapor mixture to be selectively stored based on the measured pressure.

26. The system of claim 7, wherein the first and second pressure modules include one or more pressure sensors configured to measure a pressure of the portion of the MR vapor that is removed from the MR fluid, and wherein the first and second pressure modules further include computer-readable instructions, which when executed, configure the first and/or second pressure modules to respectively control the first and/or second valves configured in relation to the storage vessel array to cause the portion of the MR vapor that is removed from the MR fluid to be selectively stored based on the measured pressure.

27. The method of claim 15, wherein the first and second pressure modules include one or more pressure sensors configured to measure a pressure of the portion of the MR vapor that is removed from the MR fluid, and wherein the first and second pressure modules further include computer-readable instructions, which when executed, configure the first and/or second pressure modules to respectively control the first and/or second valves configured in relation to the storage vessel array to cause the portion of the MR vapor that is removed from the MR fluid to be selectively stored based on the measured pressure.

* * * * *